United States Patent [19]

Kubota et al.

[11] 4,036,042

[45] July 19, 1977

[54] APPARATUS FOR ADJUSTING BIASING FORCE OF LEAF SPRING

[75] Inventors: Hitoshi Kubota; Takayuki Nishi, both of Yokohama; Takashi Kobayashi, Fujisawa, all of Japan

[73] Assignee: Hitachi, Ltd., Japan

[21] Appl. No.: 715,157

[22] Filed: Aug. 17, 1976

[30] Foreign Application Priority Data

Aug. 20, 1975 Japan ..... 50-100211

[51] Int. Cl.[2] ..... B21D 11/10

[52] U.S. Cl. ..... 72/9; 29/407; 72/389; 72/454

[58] Field of Search ..... 72/9, 389, 454, 10, 72/702, 701; 29/407

[56] References Cited

U.S. PATENT DOCUMENTS

| | | | |
|---|---|---|---|
| 283,535 | 8/1883 | Tittle | 72/454 |
| 3,459,018 | 8/1969 | Miller | 72/702 |
| 3,949,588 | 4/1976 | Seo | 72/389 |

*Primary Examiner*—C.W. Lanham
*Assistant Examiner*—Gene P. Crosby
*Attorney, Agent, or Firm*—Craig & Antonelli

[57] ABSTRACT

An apparatus for adjusting biasing forces of leaf springs, for example, those incorporated in an armature of an electromagnet relays. The apparatus is adapted to measure the biasing forces of the leaf springs, to compare the measured values with a reference value, to determine the direction and the extent of the required adjustment and to impart a plastic deformation in the determined direction and by the determined extent thereby to correct or adjust the biasing force to make the later fall within a predetermined range.

2 Claims, 9 Drawing Figures

APPARATUS FOR ADJUSTING BIASING FORCE OF LEAF SPRING

BACKGROUND OF INVENTION

The present invention is concerned with an apparatus for adjusting biasing forces of such leaf springs.

Such leaf springs have been known and widely used as adapted to exert, at their one ends, a predetermined pressing force onto associated members while the other ends being fixed, as those for example in an armatures of electromagnet relays. The biasing force exerted by those springs inconveniently fluctuates, unfortunately, due to inherent warping of the spring materials or due to change or deviation in the dimensions of machines in which the springs are incorporated, which change or deviation inevitably occurs during manufacturing or assembling. Thus, it has been necessary to correct or adjust the forces of the springs, especially in those machines which require biasing forces of springs strictly regulated to fall within a predetermined range, as for example in electromagnet relays, after the assembling or installation of the machine. This adjustment has required troublesome steps of at first measuring the biasing forces of springs after assembling and then imparting slight plastic deformation repeatedly to those springs exhibiting unacceptably high or low biasing force, through bending by, for example, pincers. The bending has to be repeated, at each time measuring the adjusted force, until the biasing force comes up or down to fall within the predetermined range.

These works conventionally required for adjusting the force are extremely inefficient and are likely to cause damages in the spring when imparting the plastic deformation to the later.

SUMMARY OF INVENTION

According to the invention, there is provided an apparatus for adjusting biasing force of such leaf springs adapted to at first measure the biasing force of the spring incorporated or installed in an assembly, to compare the measured value with a predetermined reference force to judge whether it is acceptable, to determine the direction and the amount of a plastic deformation to be imparted to those springs found to exhibit unacceptable biasing force, and to adjust the biasing force by moving a roller on the spring supported by a pair of stationary rollers in above determined direction by a travel corresponding to above determined amount, thereby to impart a required plastic deformation.

It is therefore an object of the invention to overcome above described shortcomings of the prior art by providing an apparatus for correcting or adjusting the biasing force of such leaf springs by at first measuring the pressing force of the spring already assembled in a machine and then automatically imparting an adequate plastic deformation to the spring when the measured biasing force is out of the predetermined range.

Other objects and advantageous features of the invention will become apparent in consideration of the ensuing description and the accompanying drawings in which.

DETAILED DESCRIPTION

Figure 1:
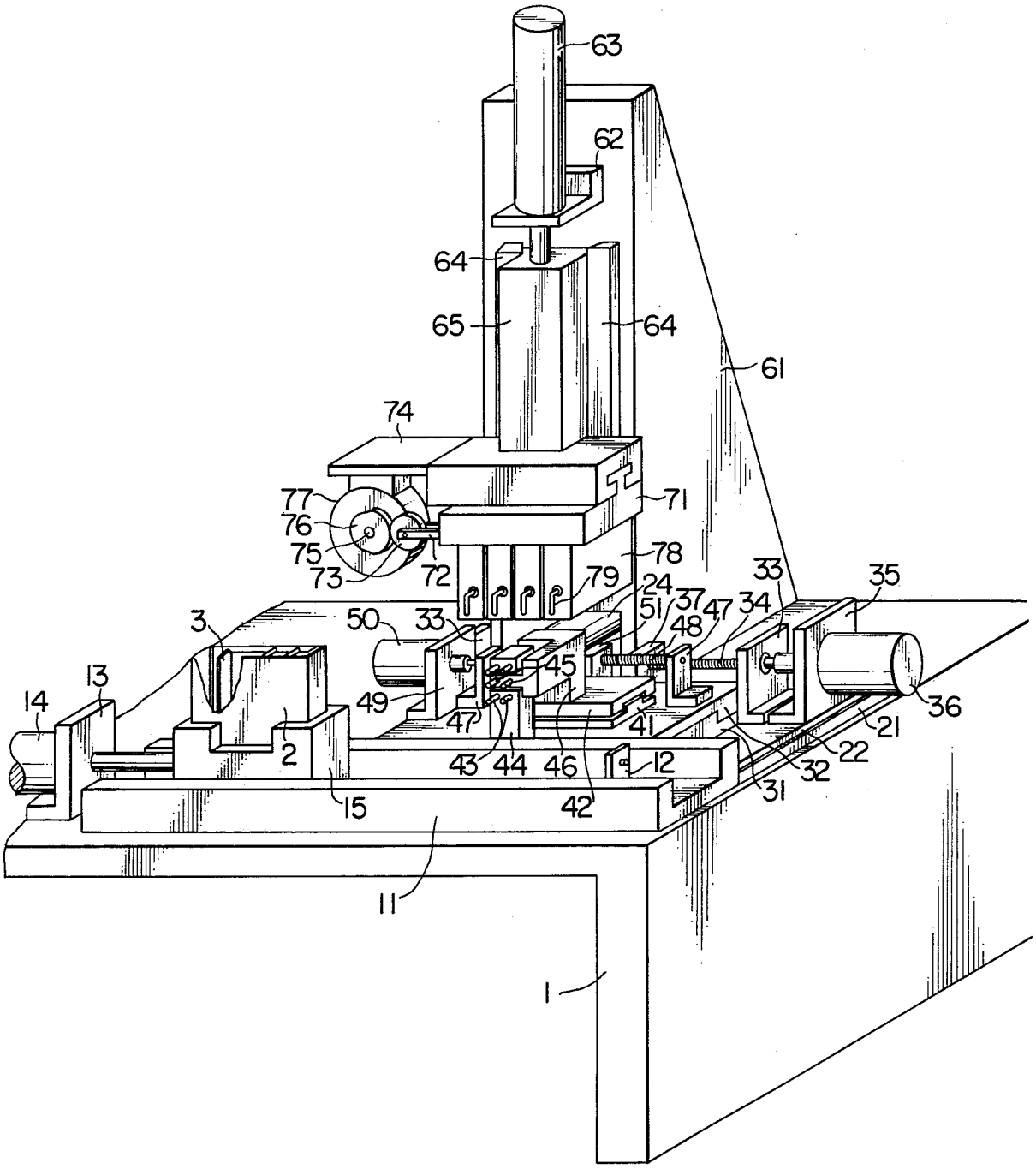
FIG. 1 is a perspective view of an apparatus for adjusting biasing force of springs embodying the present invention.

Referring at first to FIG. 1, an apparatus for adjusting the biasing force of such leaf springs is shown to have positioning means including rail means 11 fixed to a column 1, a stopper 12 adjustably fixed to the rail means 11, pneumatic cylinder 14 secured to the column 1 through an attaching member 13 and a jig 15 connected to the end of a cylinder rod of the cylinder 14 and adapted to be moved by the cylinder 14 along the rail means 11 thereby to position an assembly apparatus 2 in which the leaf spring to be adjusted is incorporated.

The apparatus comprises also means for moving a later-mentioned adjusting means back and forth, to and from the jig 15 said means including as will be seen more clearly from FIG. 2, a guide plate 21 fixed along the rail means 11, a sliding plate 22 supported by the guide plate 21 for a horizontal movement perpendicular to the direction of movement of said jig 15, and a pneumatic cylinder 24 secured to the column through an attaching member 23 and having a cylinder rod one end of which being connected to said sliding plate 22 to slidingly move the later on the guide plate 21.

Figure 2:
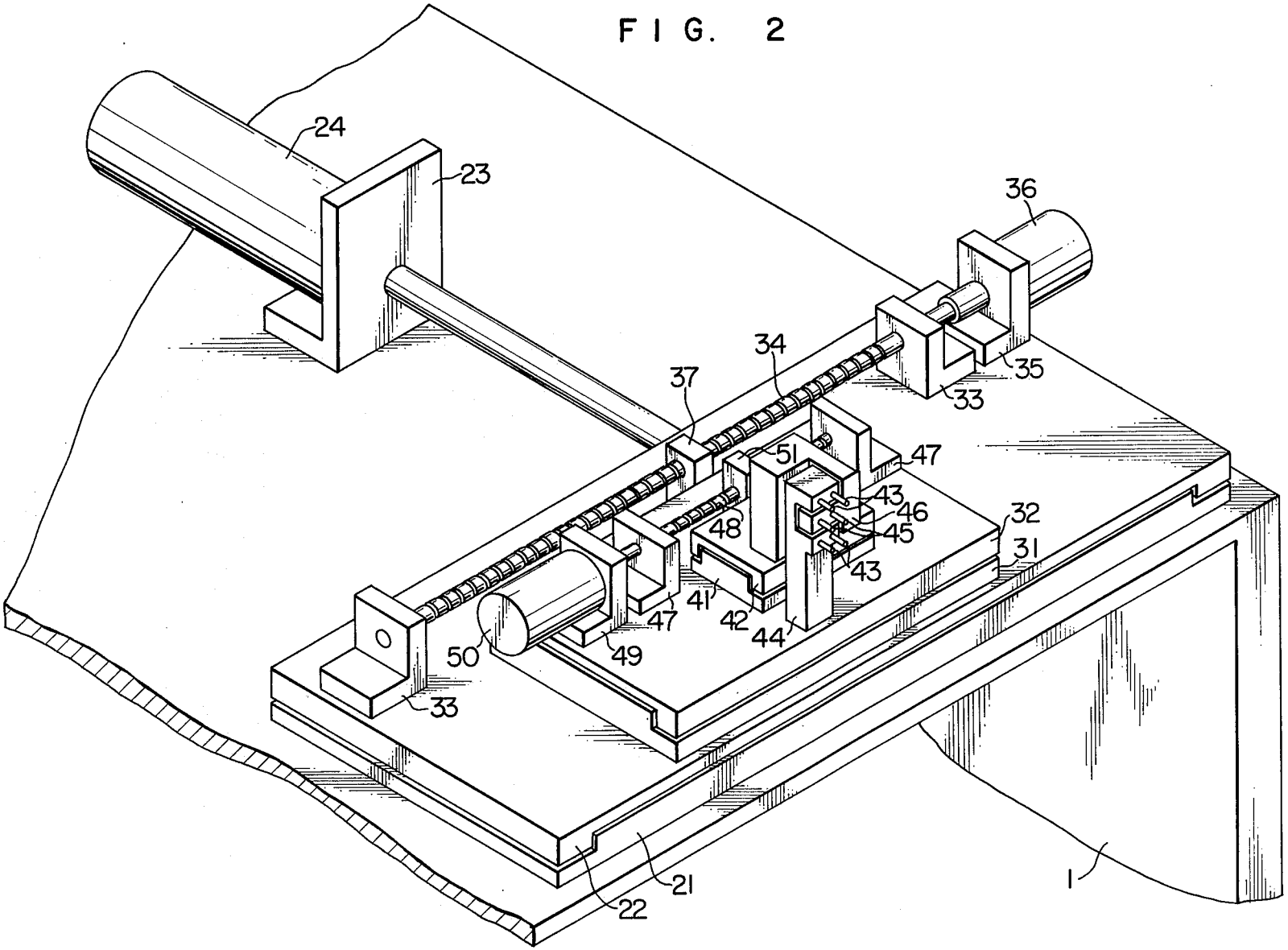
FIG. 2 is an enlarged perspective view of adjusting means incorporated in the apparatus of FIG. 1.

The apparatus further has indexing means consisting of, as shown also in FIG. 2, a guide 31 fixed on the sliding plate 22, a slider 32 supported by the guide 31 for a horizontal movement in a direction perpendicular to the direction of the movement of the sliding plate 22, an indexing screw 34 supported on said sliding plate 22 through a pair of bearings 33, an indexing motor 36 secured to the sliding plate 22 through an attaching member 35 and connected to the indexing screw 34, and a sliding block 37 fixed to the slider 32 and engaging the indexing screw 34 thereby to convert the rotation of the indexing screw 34, upon actuation by the indexing motor 36, into an axial linear movement and transfer it to the slider 32.

The apparatus of the invention still further comprises adjusting means including an adjusting guide 41 fixed on a slider 32 of the indexing means, an adjusting slider 42 supported by the adjusting guide 41 for a sliding movement in the direction same with that of the slider 32, a stationary roller block 44 secured to the slider 32 and having four stationary rollers 43 positioned at respective corners of a rectangle, said stationary rollers being adapted to detect the contact with the leaf spring 3, a movable roller block 46 fixed to said adjusting slider 42 and having two movable rollers 45 disposed respectively between two of the stationary rollers 43, the movable rollers being adapted to detect the contact with the leaf spring 3, an adjusting screw 48 supported by the slider 32 through a pair of bearings 47, an adjusting motor 50 secured to the slider 32 through an attaching member 49 and connected to one end of the adjusting screw 48, and a slide block 51 secured to the adjusting slider 42 and convert the rotation of the adjusting shaft 48 to a linear movement in the axial direction of the adjusting shaft 48 and deliver the linear movement to the adjusting slider 42.

The apparatus is still further comprised of raising and lowering means including a stay 61 fixed to the column 1, a pneumatic cylinder 63 supported to extend vertically by the stay 61 through an attaching member 62, and a ram 65 connected to a cylinder rod of the cylinder 63 and adapted to be guided by a pair of guide blocks 64 affixed to the stay 61.

As a still further component, the apparatus comprises measuring means including a suspended bed 71 slidably supported by the ram 65 of the raising and lowering means to be suspended from the lower surface of the ram 65, the suspended bed being biased by a spring (not shown) in one direction, a cam follower 73 rotatably supported by an arm 72 extending from one end surface of the suspended bed 71, a motor 77 secured to an attaching member 74 projecting from an end surface of the ram 65 and having a shaft 75 carrying a cam 76 adapted to contact and cooperate with the cam follower 73, and measuring elements 78 adapted to transform biasing force detected by sensors 79 into a voltage.

Figure 3:
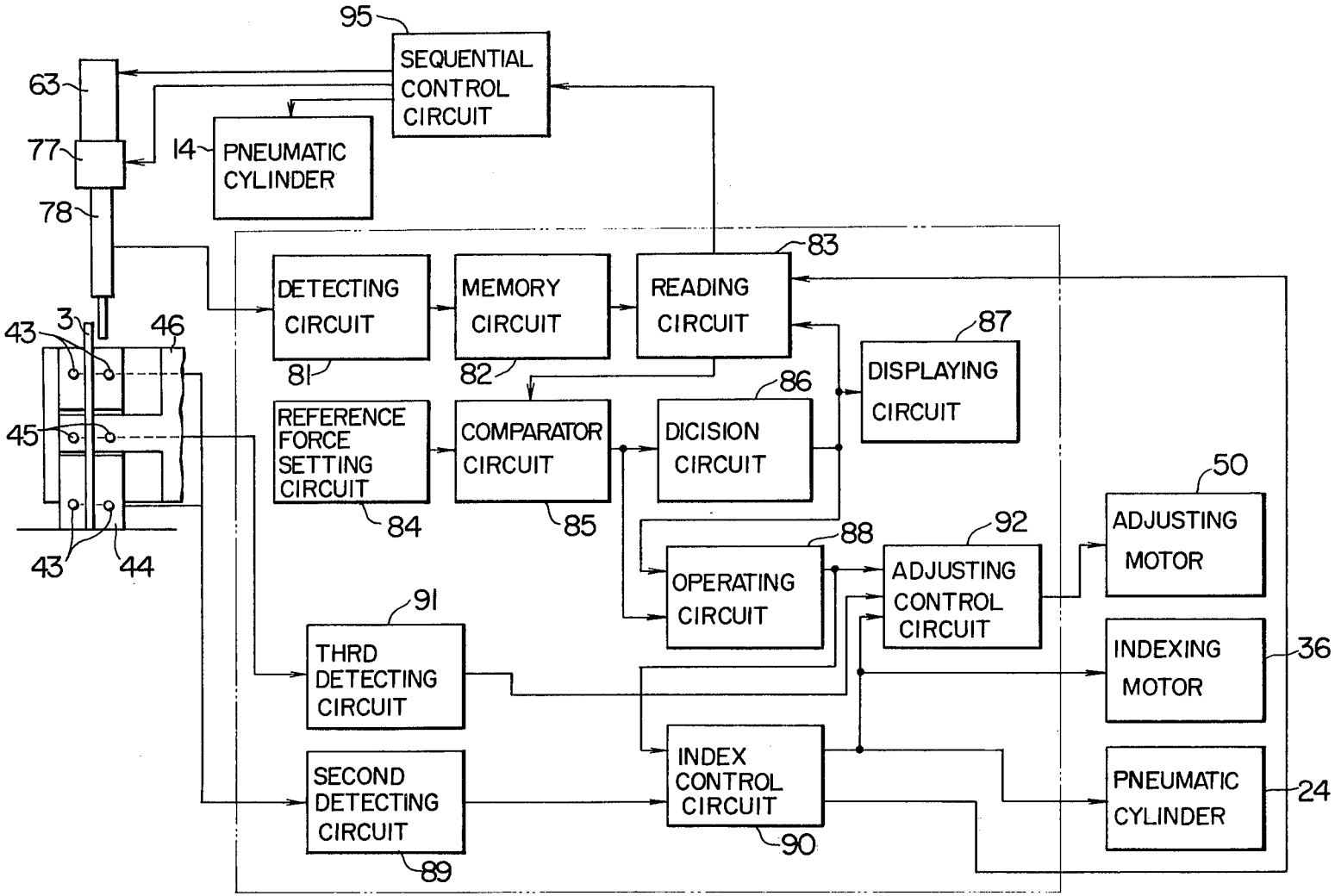
FIG. 3 is a block diagram of control means incorporated in the apparatus of the invention.

Referring now to FIG. 3, the apparatus of the invention still further comprises a control circuit means which consist of the following circuits of:

a. a detecting circuit 81 connected to the measuring elements 78 adapted to detect a voltage corresponding to a biasing force which is predetermined with respect to a certain deflicted position of the leaf springs 3 from the voltages delivered from the measuring elements 78 which voltages being representative of the biasing forces of the leaf springs 3;

b. a memory circuit 82 connected to the detecting circuit 81 and adapted to remember the positions of respective leaf springs, as well as the biasing forces of respective leaf springs which are delivered from the detecting circuit 81;

c. a reading circuit 83 connected to the memory circuit 82 to read out the content of the memory;

d. a reference force setting circuit 84 adapted to set a voltage corresponding to a predetermined reference or standard magnitude of the biasing force;

e. a comparator circuit 85 connected to both of the reading and reference force setting circuits 83, 84 thereby to compare the biasing force input by the reading circuit 83 with the reference biasing force input by the reference force setting circuit 84;

f. a decision circuit 86 connected to the comparator circuit 85 and adapted to decide whether the detected force is acceptable or not, upon receipt of a signal from the comparator circuit 85;

g. a displaying circuit 87 connected to the decision circuit 86 to display the result of the decision;

h. an arithmetic or an operation circuit 88 connected to both of the comparator circuit 85 and the decision circuit 86 and adapted to operate or calculate the direction and the amount of the adjustment required for the spring, in accordance with the signal delivered from the decision circuit, when the spring is decided to have unacceptable biasing force;

i. a second detecting circuit 89 adapted to detect the contact of the stationary rollers 43 and the leaf springs 3;

j. an index controlling circuit 90 adapted to actuate or energize the indexing motor 36 in accordance with the result of the calculation delivered from the operating circuit 88 thereby to position the stationary rollers 43 and the movable rollers 45 to respective positions corresponding to the leaf spring decided to be unacceptable, the index control circuit 90 further being adapted to actuate the cylinder 24 of the means for moving the adjusting means back and forth thereby to fit the stationary and movable rollers 43 and 45 to the spring, and then to restart the motor 36 thereby to make the stationary rollers 43 in contact with the spring 3 and to stop the motor 36 when a signal is issued from the second detecting circuit 89 which signal being the representative of the contact, thereby performing the indexing;

k. a third detecting circuit 91 adapted to detect the contact of the movable rollers 45 with the spring 3; and l. an adjusting control circuit 92 connected to the operation circuit 88, index control circuit 90 and to the third detecting circuit 91, the circuit 92 being adapted to energize the motor 50 for the adjusting means upon receipt of a signal representative of the completion of the indexing from the index control circuit 90 and, in accordance with the signal delivered from the operation circuit 88, so as to make the movable rollers 45 in contact with the leaf spring 3, the circuit 92 further adapted to perform the adjustment in accordance with the output from the operation circuit 88 after the contact of the movable rollers 45 with the leaf spring 3 is detected by the third detecting circuit.

The output of the decision circuit 86 is delivered also to the reading circuit 83 to act as an order to make the later read the position and the force of the subsequent spring when it is decided to be acceptable. The index control circuit 90 is also connected to the reading circuit 83.

The apparatus includes as a final component a sequential control circuit 95 connected to the reading circuit 83 for sequentially controlling the cylinder 14 of the positioning means, the cylinder 63 of the raising and lowering means and the motor 77 of the measuring means.

In operation, an assembly 2 which is typically an electromagnet relay incorporating a plurality of leaf spring 3 is attached to the jig 15. The jig 15 is moved along the rail means 11 to the right-hand side as viewed in FIG. 1, by the actuation of the cylinder 14 ruled by the sequence control circuit 95, until it comes to abut the stopper 12. As the jig 15 abuts the stopper 12 to be stopped thereat, thereby to position the spring 3 of the assembly 2 at a predetermined location, the sequence control circuit 95 then acts to actuate the cylinder 63 so that the ram 65 is lowered along the guide block 64 until the sensors 79 of the measuring element 78 come to oppose to the free ends of the spring without contacting later. The sequence control circuit 95 then issues a further signal to actuate the motor 77 for precisely one rotation, which makes the cam 76 to rotate precisely through 360°. Consequently, the cam follower 73 is moved horizontally causing one reciprocating motion of the suspended bed 71 between a stand by position and a measuring position. During this movement of the suspended bed 71, the sensors 79 contact the free ends of the leaf springs 3 and urges the springs to sense or measure the biasing force of the leaf springs 3 at a preselected urged condition of the later. The detected biasing forces of the leaf springs 3 are then transformed into voltages by the measuring elements 78 which voltage is then applied to the memory circuit 82 to be remembered therein along with the positions of the leaf springs 3. The sequence control circuit 95 then issues a signal to actuate the cylinder 63 thereby raise the ram 65 and, consequently, the measuring elements 78. The positions and the biasing forces remembered by the memory circuit 82 are read out in a predetermined sequence of the leaf springs 3 by the reading circuit 83. As the reading circuit 83 reads out the position and the biasing force of the first leaf spring 3, the read out data are applied to the comparator circuit 85 which compares these data with the reference value previously set in the reference force setting circuit 84, the result of which is delivered to the decision circuit 86 and to the operation circuit 88. The decision circuit 86 decides, upon receipt of the output from the comparator circuit 85, whether the biasing force of the first spring is within a predetermined range or not, i.e. whether the first leaf spring is acceptable or not, the result of the decision is delivered to the display circuit 87 and the operation circuit 88, as well as to the reading circuit 83. Supposing here that the biasing force of the first leaf spring 3 is decided to be within the predetermined range, i.e. the first leaf spring 3 is found to be acceptable, the reading circuit is started again to read out the position and the biasing force of the second leaf spring 3. At the same time, the display circuit 87 acts to display that the first leaf spring 3 is acceptable. However, the operation circuit 88 does not work when the signal delivered from the decision circuit 86 is representing that the leaf spring examined is acceptable. The second leaf spring 3 is examined in the same manner. The position and the biasing force are compared with the reference values by the comparator circuit 85, the result of which is then sent to the decision circuit 86. Assuming that the decision circuit decides that the secondly examined leaf spring 3 has a biasing force out of the predetermined range, i.e. the secondly examined spring is found unacceptable, the reading circuit 83 does not work for the next, i.e. the third, leaf spring 3, while the display circuit 87 makes a display to show that the secondly examined leaf spring 3 is faulty and unacceptable.

Figure 4A:
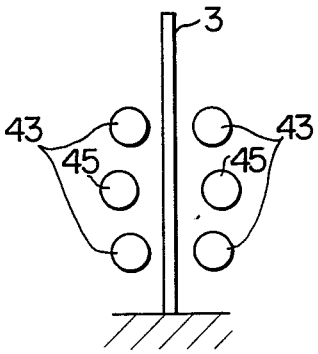
FIGS. 4(a), (b), (c), (d), (e) and (f) are an illustration explanatory of steps for correcting the biasing force of a spring.

Upon receipt of a signal representing that the secondly examined leaf spring 3 is unacceptable, from the decision circuit 86, the operation circuit 88 calculates the direction of the adjustment, i.e. the direction in which the force for correcting the leaf spring 3 is to be applied, and the amount of the adjustment required, on the basis of the result of the comparison made in the comparator circuit 85. The calculated data are then transferred along with the signal representative of position of the leaf spring 3, to the index control circuit 90. The index control circuit 90 energizes the motor 36, upon consideration of the delivered signals representing the position of the faulty spring and the direction and the amount of the adjustment, to rotate the indexing screw 34 thereby to move the stationary rollers 43 and the movable rollers 45 to the position of the second leaf spring 3, through the movement of the slider 32 which is caused by the movement of the slide block 37 on the indexing screw 34. Then, the cylinder 24 of means for moving the indexing means back and forth is actuated to move the sliding plate 22, so as to position the rollers in such a manner that the two stationary rollers 43 and one interposed movable roller 45 are located at each side of the leaf spring 3, as shown in FIG. 4(a).

Figure 4B:
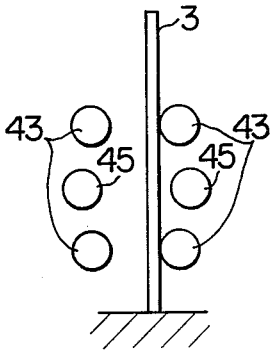
Figure 4C:
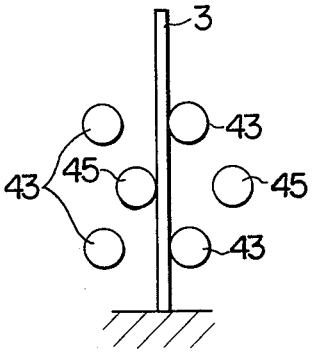
Figure 4D:
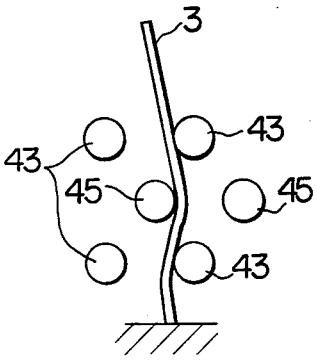
Figure 4E:
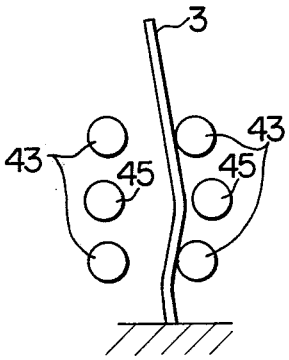
Figure 4F:
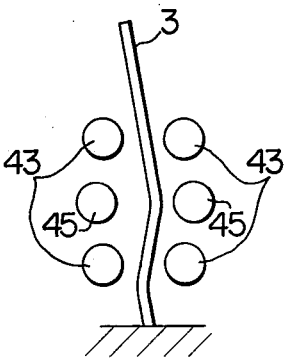

The indexing motor 36 is then started again to rotate the indexing screw 34 thereby to move the stationary and movable rollers 43 and 45 in the direction as calculated by the operation circuit. The indexing motor 36 is stopped when the stationary rollers 43 come in contact with the leaf spring as shown in FIG. 4(b), by the index control circuit 90 which is delivered a signal representing the contact from the second detecting circuit 89, thereby completing the indexing. Upon completion of the indexing, the indexing control circuit 90 delivers a signal representative of the completion to the adjusting control circuit 92 which in turn actuates the adjusting motor 50 in accordance with the data calculated by the operation circuit 88. Accordingly, the adjusting slide block 51 is moved along the adjusting screw 48 which in turn moves the adjusting slider 42 in the direction of correcting or adjusting, which direction has been given by the operation circuit 88. As the movable roller 45 comes to in contact with the leaf spring 3, as shown in FIG. 4(c), the contact is detected by the third detecting circuit 91 which delivers a corresponding signal to the adjusting control circuit 92. The adjusting control circuit 92 continues the energization of the motor 50 until the movable roller is moved from the point where it comes in contact with the spring 3 by a distance corresponding to the amount of required adjustment or correction which has been given by the operation circuit 88, thereby imparting a plastic deformation as shown in FIG. 4(d). After the predetermined plastic deformation is imparted to the leaf spring 3, the motor 50 is stopped and again started by the adjusting control circuit 92 in the reverse direction, thereby to return the movable roller 45 to the position as shown in FIG. 4(e). The index control circuit 90 then actuates, after the returning of the movable roller 45, so as to move the slider 22, thereby to return the stationary and movable rollers 43 and 45 to the position of FIG. 4(f), and actuates the cylinder 24 so as to move the rollers 43 and 45 away from the leaf spring 3. A signal representative of the completion of adjustment is then delivered from the index control circuit 90 to the reading circuit 83 which then turns to read out the data of the next, i.e. the third, leaf spring.

All leaf springs 3 installed in the assembly 2 are examined successively in the described manner and the adjustment is performed with the leaf springs 3 which are found to be unacceptable.

When the all springs are examined and required adjustment are finished with the assembly 2, a signal representative of all leaf springs 3 being acceptable is delivered from the decision circuit 86 or a signal representing that the required adjustment is completed is delivered from the index control circuit 90, respectively to the reading circuit 83. The reading circuit 83 then imparts a signal representing the completion of the adjustment to the sequential control circuit 95 which then actuates the cylinder 14 of the positioning means so as to move the jig 15 away from the stopper 12. The assembly 2 is then demounted from the jig 15 by suitable means.

The subsequence assembly 2 is then tested and adjusted in the similar manner.

Although a specific embodiment has been described solely for the purpose of understanding of the invention, it will be clear to those skilled in the art that many changes and modifications are possible without departing from the scope of the invention.

For example, the sequence control circuit 95 may be modified to perform the adjustment for one spring in a plurality of steps of imparting the plastic deformation during each step measuring the corrected biasing force so as to correct the force gradually until it comes to fall within the predetermined range. Such sequence control circuit is suitable especially in the case where the allowable range of fluctuation is strictly limited.

At the same time, it is possible to examine and adjust a plurality of assemblies at one time, each assembly having only one leaf spring 3, substantially in the same manner and arrangement as above.

In case that the assemblies having only one leaf spring is to be examined and adjusted one after another, only one measuring element 78 is required, and the memory circuit 82, reading circuit 83 and the indexing circuit 90 are dispensed with. In this case, the connection in the control circuit means are made such that the output of the detecting circuit 81 is delivered to the comparator circuit 85, while the output from the detecting circuit 89 is delivered to the adjusting control circuit 92 to which the motor 36 and the cylinder 24 are connected. The signal representing the completion of the adjustment is picked up from the adjusting control circuit 92 and is input to the sequence control circuit 95 along with the result of the decision by the decision circuit 86.

While preferred embodiments have been described using specific terms, such description is for illustrative purposes only, and it is to be understood that changes and variations may be made without departing from the scope of the invention which is restricted solely by the appended claims.

We claim:

1. An apparatus for adjusting biasing force of a leaf spring comprising:

a. means for adjusting said biasing force through imparting to said leaf spring a plastic deformation, said biasing force adjusting means having at least four stationary rollers for supporting said leaf spring and at least two movable rollers adapted to impart said plastic deformation to said leaf spring while it is supported by said stationary rollers;

b. means carrying said adjusting means for moving said stationary and movable rollers of said adjusting means to and from said leaf spring;

c. means for measuring the biasing force of said leaf spring having at least one measuring element adapted to make one reciprocating movement between a stand-by position where it does not contact said leaf spring and a measuring position where said leaf spring is deflected by said measuring element by a predetermined amount;

d. a sequence control circuit for controlling the operation of said measuring means; and e. control circuit means connected to said measuring element of said measuring means and to said stationary and movable rollers of said adjusting means, said control circuit means being adapted to compare the measured biasing force of said leaf spring with a reference value to decide whether the measured biasing force is acceptable, to determine the direction in which the plastic deformation is to be imparted and the amount of deformation to be imparted when said biasing force is decided to be unacceptable, and to control said adjusting means and said means for moving said stationary and movable rollers in accordance with the determined direction and amount thereby to adjust the biasing force of said leaf spring.

2. An apparatus for adjusting biasing forces of leaf springs comprising:

a. means for adjusting said biasing force through imparting to said leaf springs plastic deformations, said means having at least four stationary rollers adapted to support said leaf spring and at least two movable rollers for imparting said plastic deformation while one of said leaf spring being supported by said stationary rollers;

b. indexing means carrying said adjusting means and adapted to move said adjusting means thereby to position the later at positions corresponding to the leaf springs;

c. means carrying said indexing means for moving said indexing means and said adjusting means to and from said leaf springs;

d. means for measuring the biasing forces of said leaf springs having a plurality of measuring elements adapted to make one reciprocating movement between a stand-by position where the elements oppose to associated leaf springs without making contact therewith and a measuring positions where the springs are deflected by said elements by a predetermined amount;

e. a sequence control circuit for controlling the operation of said measuring means; and f. control circuit means connected to said measuring elements of said measuring means and to said stationary and movable rollers of said adjusting means, said control circuit means being adapted to remember the measured biasing forces along with the positions of said leaf springs, to read out the content of memory for the successive leaf springs to compare the measured biasing forces with a reference value, to determine the direction in which said plastic deformation is to be imparted and the amount of said plastic deformation to be imparted on the basis of the comparison when a leaf spring is found to exhibit an unacceptable biasing force, to position said adjusting means through actuation of said indexing means by moving it in said direction and by said amount and to control said means for moving indexing means, as well as said adjusting means, thereby to adjust the biasing force of said leaf spring found to exhibit unacceptable biasing force.

* * * * *